US009879198B2

(12) United States Patent
Forbus

(10) Patent No.: US 9,879,198 B2
(45) Date of Patent: Jan. 30, 2018

(54) LOW SHEAR STRENGTH LUBRICATING FLUIDS

(71) Applicant: Thomas Reginald Forbus, Doylestown, PA (US)

(72) Inventor: Thomas Reginald Forbus, Doylestown, PA (US)

(73) Assignee: Santolubes LLC, Spartanburg, SC (US)

( * ) Notice: Subject to any disclaimer, the term of this patent is extended or adjusted under 35 U.S.C. 154(b) by 0 days.

(21) Appl. No.: 14/952,040

(22) Filed: Nov. 25, 2015

(65) Prior Publication Data

US 2017/0145336 A1 May 25, 2017

(51) Int. Cl.
*C10M 105/38* (2006.01)
*C10M 105/42* (2006.01)
*C10M 105/36* (2006.01)

(52) U.S. Cl.
CPC ..... *C10M 105/36* (2013.01)

(58) Field of Classification Search
CPC ..... C10M 105/36; C10M 105/38; C10M 129/95; C10M 129/68; C10M 129/72; C10M 129/74
See application file for complete search history.

(56) References Cited

U.S. PATENT DOCUMENTS 4,640,792 A 2/1987 Groenhof et al.
4,795,771 A * 1/1989 Yoshihara ..... C08K 3/34 524/114
4,803,299 A * 2/1989 Mueller ..... C08G 65/20 528/408
4,891,161 A * 1/1990 Tanikawa ..... C10M 105/32 508/485
5,185,092 A * 2/1993 Fukuda ..... C09K 5/045 252/67
5,538,840 A 7/1996 Van Toan et al.
6,069,226 A * 5/2000 Muller ..... C08G 65/20 524/730
6,207,793 B1 * 3/2001 Kim ..... C08G 65/20 528/271
6,271,413 B1 * 8/2001 Muller ..... B01J 21/16 560/263
6,667,285 B1 12/2003 Kawahara et al.
2004/0242441 A1 12/2004 Chiu
2005/0176594 A1 8/2005 Grabowski et al.
(Continued)

FOREIGN PATENT DOCUMENTS

CA 2929468 A1 * 6/2015 ..... C10M 145/38
EP 0340302 A1 11/1989
(Continued)

OTHER PUBLICATIONS

The International Search Report for International Patent Application No. PCT/US2013/064487, dated Dec. 6, 2013, 3 pages.
(Continued)

*Primary Examiner* — Pamela H Weiss
(74) *Attorney, Agent, or Firm* — Morgan Lewis & Bockius, LLP

(57) ABSTRACT

The instant invention involves the use of simple and complex carboxyl esters, or mixtures thereof, of carboxyl end-capped-polytetramethylene glycols of specific structure to minimize the elastohydrodynamic shear strength of these types of fluids.

15 Claims, 4 Drawing Sheets

(56) References Cited

U.S. PATENT DOCUMENTS

| | | | | |
|---|---|---|---|---|
| 2007/0063170 | A1 | 3/2007 | Forbus | |
| 2007/0232506 | A1 | 10/2007 | Gao et al. | |
| 2010/0093573 | A1* | 4/2010 | Kocsis | C10M 141/06 508/287 |
| 2010/0113710 | A1* | 5/2010 | Horikoshi | C08K 5/103 525/418 |
| 2010/0130390 | A1 | 5/2010 | Tipton et al. | |
| 2011/0065619 | A1 | 3/2011 | Russo | |
| 2012/0283161 | A1* | 11/2012 | Jung | C07C 69/44 508/496 |
| 2013/0261035 | A1 | 10/2013 | Kovanda et al. | |
| 2015/0105305 | A1 | 4/2015 | Forbus, Jr. | |
| 2016/0272916 | A1* | 9/2016 | Kashani-Shirazi | C10M 145/38 |

FOREIGN PATENT DOCUMENTS

| | | | | |
|---|---|---|---|---|
| GB | 1417590 | A * | 12/1975 | C10L 1/198 |
| WO | WO 2015078707 | A1 * | 6/2015 | C10M 145/38 |

OTHER PUBLICATIONS

The Written Opinion for International Patent Application No. PCT/US2013/064487, dated Dec. 6, 2013, 6 pages.
International Search Report for PCT/US2016/063016 dated Apr. 4, 2017.
Written Opinion for PCT/US2016/063016 dated Apr. 4, 2017.

* cited by examiner

LOW SHEAR STRENGTH LUBRICATING FLUIDS

FIELD OF INVENTION

The present invention relates to the use of carboxyl esters, or mixtures thereof, of carboxyl di-end-capped-polytetramethylene glycols and similarly related complex esters of specific structures to minimize their elastohydrodynamic shear strength and enable the production of high efficiency fluids for machines or machine elements that operate in the elastohydrodynamic regime of lubrication.

BACKGROUND OF THE INVENTION

Elastohydrodynamic machine elements are mechanical devices that operate with a thin film of fluid between nominally smooth, rolling-sliding, elastically-deformed, non-conforming surfaces in mutual contact. Fluids in the elastohydrodynamic contact typically behave not as a viscous fluid, but as an elastic-plastic solid with a yield or shear strength to the normal rolling-shearing motion. Shearing within the contact only occurs when the two surfaces in contact have a differential in their relative speeds which can be caused simply by the geometry of the contact surfaces and their relative motion in the natural operation of machine elements.

The efficiency of these machine elements rely in large part upon the high-stress shear strength of the fluid used to lubricate the surfaces in these high-stress, elastically-deformed, non-conforming contacts. The shear strength properties of the fluid under the contact operational conditions can substantially influence their efficiency depending upon the degree of sliding motion between the mating surfaces under elastohydrodynamic conditions of lubrication. Thus, fluids with low elastohydrodynamic shear strength enable better efficiency from lower fluid shearing losses in the rolling-sliding or pure sliding motion in these contacts.

SUMMARY OF THE INVENTION

One embodiment of the present disclosure provides for a lubricating fluid comprising carboxyl di-ester of polytetramethylene glycol independently selected from the group consisting of (1) a first carboxyl di-ester of polytetramethylene glycol having the structure of formula (1):

(1)

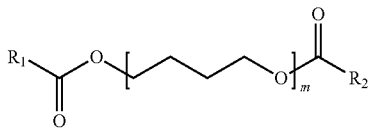

wherein $R_1$ and $R_2$ each independently comprise linear alkyl groups each having 5 to 11 carbon atoms and m ranges from 2 to 4; (2) a second carboxyl di-ester of polytetramethylene glycol having the structure of formula (2):

(2)

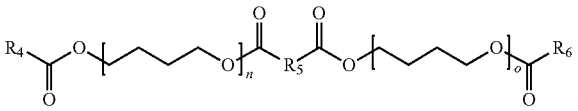

wherein $R_4$ and $R_5$ each independently comprise linear alkyl groups each having 5 to 11 carbon atoms; $R_3$ is a dicarboxylic acid, comprising linear alkyl groups having 24-36 carbon atoms and n ranges from 2 to 4 and o ranges from 2 to 4; and mixtures thereof.

In certain embodiments, the polytetramethylene glycol segment of formula (1) has an average molecular weight ranging from 200 g/mole to 300 g/mole. In certain embodiments, the polytetramethylene glycol segment of formula (2) has an average molecular weight ranging from 200 g/mole to 300 g/mole.

In some embodiments of the lubricating fluid, $R_1$ and $R_2$ are each independently derived from a mixture of octanoic carboxylic acid and decanoic carboxylic acid. In some embodiments of the lubricating fluid, $R_4$ and $R_5$ are each independently derived from a mixture of octanoic carboxylic acid and decanoic carboxylic acid.

In some embodiments of the lubricating fluid, $R_3$ is derived from a dimer carboxylic acid having 24-36 carbon atoms.

In some embodiments of the lubricating fluid, the lubricant fluid has a traction coefficient ranging from 0.001-0.015μ when measured at a slide to roll ratio of 40 percent a load of 20N to 70N at 90° C.

In some embodiments of the lubricating fluid, the lubricant fluid has a 40° C. Kinematic Viscosity ranging from 15 cSt to 1500 cSt.

In some embodiments of the lubricating fluid, the lubricating fluid comprises at least one additive selected from the group consisting of: antioxidant, extreme pressure additive, anti-wear additive, friction modifier, rust inhibitor, corrosion inhibitor, detergent, dispersant, defoamer and combinations thereof.

BRIEF DESCRIPTION OF DRAWINGS

The foregoing summary, as well as the following detailed description of embodiments of the low shear strength lubricating fluid and methods of the present invention, will be better understood when read in conjunction with the appended drawings of exemplary embodiments.

In the drawings.

DESCRIPTION OF THE PREFERRED EMBODIMENT

Figure 1:
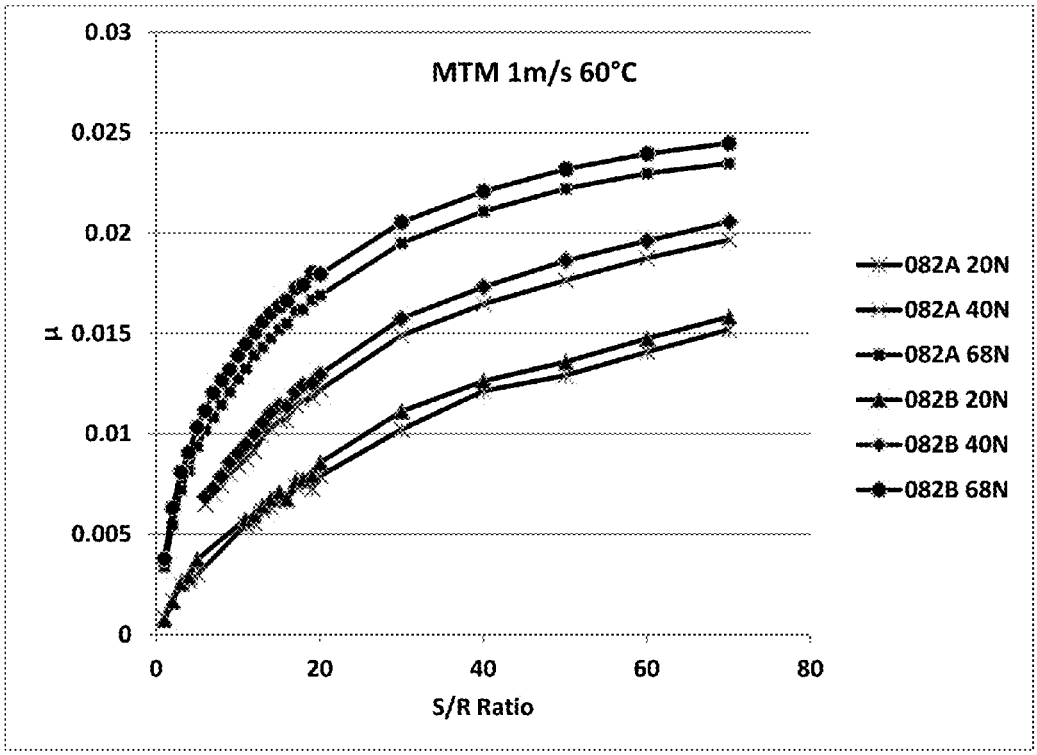
FIG. 1 illustrates the plots of slide/roll ratio versus traction coefficient, μ, measured at loads of 20N (0.8 GPa), 40N (1.0 GPa) and 68N (1.2 GPa), 60° C. and an entrainment speed to 1 meters/second for two different compositions of the present invention.

The present invention provides ester base oils for formulated lubricants of very low elastohydrodynamic shear strength in a range of viscosities from low-to-high for the production of lubricating fluids of high energy efficiency fluids for elastohydrodynamic lubrication.

Base Oils

The present invention utilizes carboxylic esters, or mixtures thereof, of carboxyl di-end-capped-polytetramethylene glycols and similarly related complex esters of specific structures to minimize their elastohydrodynamic (EHD) shear strength and enable the production of high efficiency fluids for machines or machine elements that operate in the elastohydrodynamic regime in lubrication.

One embodiment provides for a lubricating fluid comprising a first carboxyl di-ester of polytetramethylene glycol of low molecular weight polytetramethylene glycols and low viscosity. In one embodiment, the first carboxyl di-ester of polytetramethylene glycol has the structure of formula (1).

(1)

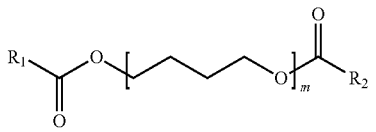

In some embodiments of formula (1), $R_1$ and $R_2$ each independently comprise linear alkyl groups each having 5 to 11 carbon atoms. In some embodiments of formula (1), $R_1$ and $R_2$ each independently comprise linear alkyl groups each having 7 to 9 carbon atoms. In various embodiments of formula (1), each polytetramethylene glycol segment of formula (1) has an average molecular weight ranging from 200 g/mole to 300 g/mole. In various embodiments of formula (1), $R_1$ and $R_2$ are each independently derived from a mixture of octanoic carboxylic acid and decanoic carboxylic acid. In each of the foregoing embodiments of formula (1), m ranges from 2 to 4. Further, in each of the foregoing embodiments of formula (1), $R_1$ and $R_2$ each may contain branched alkyl groups having 5 to 11 carbon atoms or 7 to 9 carbon atoms wherein the amount of branched alkyl groups is less than 10 wt. %, less than 5 wt. %, or less than 1 wt. %. For each of the foregoing embodiments, the first carboxyl di-ester of polytetramethylene glycol is a liquid at 25° C.

Another embodiment provides for a lubricating fluid comprising a second carboxyl di-ester of polytetramethylene glycol derived from coupling long predominately-linear chain di-carboxylic acids with poly-tetramethylene glycol followed by capping residual hydroxyl groups with normal carboxylic acids, preferably mixed-chainlink, linear (or "normal") carboxylic acids to form medium-to-high viscosity complex esters.

In one embodiment, the second carboxyl di-ester of polytetramethylene glycol has the structure of formula (2).

(2)

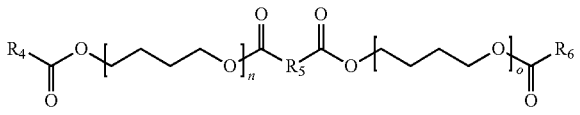

In some embodiments of formula (2), $R_4$ and $R_5$ each independently comprise linear alkyl groups each having 5 to 11 carbon atoms, $R_3$ comprises a linear alkyl group having 32-36 carbon atoms. In some embodiments of formula (2), $R_4$ and $R_5$ each independently comprise linear alkyl groups each having 7 to 9 carbon atoms. In various embodiments of formula (2), each polytetramethylene glycol segment of formula (1) has an average molecular weight ranging from 200 g/mole to 300 g/mole. In various embodiments of formula (2), $R_4$ and $R_5$ are each independently derived from a mixture of octanoic carboxylic acid and decanoic carboxylic acid. In various embodiments of formula (2), $R_3$ is derived from a dimer carboxylic acid having 36 carbon atoms. In other embodiments of formula (2), the dimer carboxylic acid has 24-36 carbon atoms; 28-36 carbon atoms; 30-36 carbon atoms; 32-36 carbon atoms; 34-36 carbon atoms or 35 carbon atoms. In certain such embodiments of formula (2), the dimer acids (dimerized unsaturated fatty acids) are dicarboxylic acids prepared by dimerizing unsaturated fatty acids. In one such embodiment, the dicarboxylic acid is the predominately-linear dimer derived from oleic acids that can be left unsaturated or finished by saturation with hydrogen to remove residual unsaturation (olefinic bonds) from the structures. In each of the foregoing embodiments of formula (2), n ranges from 2 to 4 and o ranges from 2 to 4. Further, in each of the foregoing embodiments of formula (2), $R_4$ and $R_5$ each may contain branched alkyl groups having 5 to 11 carbon atoms or 7 to 9 carbon atoms wherein the amount of branched alkyl groups is less than 10 wt. %, less than 5 wt. %, or less than 1 wt. %. Further in each of the foregoing embodiments, $R_3$ may contain branched alkyl groups wherein the amount of branched alkyl groups is less than 10 wt. %, less than 5 wt. %, less than 1 wt. %. For each of the foregoing embodiments, the second carboxyl di-ester of polytetramethylene glycol is a liquid at 25° C.

Another embodiment provides for a lubricating fluid comprising a mixture of each of the foregoing embodiments of the first and second carboxyl di-ester of polytetramethylene glycols described herein. The first and second carboxyl di-ester polytetramethylene glycols are blended at ratios to obtain a product having a desired ISO viscosity grade. Preferred viscosity ranges of a mixture of first carboxyl di-ester of polytetramethylene glycol and second carboxyl di-ester of polytetramethylene glycols are kinematic viscosities from 15 to 1500 Centistokes at 40° C.; or 15 to 1000 Centistokes at 40° C.

The lubricating fluids containing the first and/or second carboxyl di-ester of polytetramethylene glycols described herein have extremely low shear strength in elastohydrodynamic sliding and rolling-sliding contacts and will therefore enable lubricants used in elastohydrodynamic lubrication to be produced that have high energy efficiency from low shearing losses that occur within the lubricated contacts. In one embodiment, the lubricant fluid has a fraction coefficient ranging from 0.001-0.015μ when measured at a slide to roll ratio of 40 percent a load of 20N to 70N at 90° C.

With reference to FIG. 1, the relative order of elastohydrodynamic shear strength of various base oil is: Group I Mineral Oil>Polyalphaolefin>Polyalkylene Glycol>the first and/or second carboxyl di-ester of polytetramethylene glycols, as produced and described herein, are quite substantially lower than the next lowest member of the four-member series, polyalkylene glycols.

Additives

The various embodiments of lubricating fluids described herein may further comprise at least one additive selected from the group consisting of: antioxidant, extreme pressure additive, anti-wear additive, friction modifier, rust inhibitor, corrosion inhibitor, detergent, dispersant, defoamer and combinations thereof.

Examples of dispersants include ashless dispersants, useful for the present invention, include those based on polybutenyl succinic acid imide, polybutenyl succinic acid amide, benzylamine, succinic acid ester, succinic acid ester-amide and a boron derivative thereof. The ashless dispersant is incorporated normally at 0.05 to 7% by mass.

Examples of metallic detergent may be selected from those containing a sulfonate, phenate, salicylate, and phosphate of calcium, magnesium, barium or the like. It may be optionally selected from perbasic, basic, neutral salts and so forth of different acid value. The metallic detergent is optionally incorporated at 0.05 to 5% by mass.

Examples of pour point depressants useful for the present invention include ethylene/vinyl acetate copolymer, condensate of chlorinated paraffin and naphthalene, condensate of chlorinated paraffin and phenol, polymethacrylate, polyalkyl styrene and so forth. The pour point depressant is incorporated normally at 0.1 to 10% by weight.

Examples of defoaming agents which can be used for the present invention include polydimethylsilicone, trifluoropropylmethylsilicone, colloidal silica, a polyalkyl acrylate, a polyalkylmethacrylate, an alcohol ethoxy/propoxylate, a fatty acid ethoxy/propoxylate, and a sorbitan partial fatty acid ester. The defoaming agent may be incorporated normally at 10 to 100 ppm by mass.

Examples of antioxidants which can be used for the present invention include amine-based ones, e.g., alkylated diphenylamine, phenyl-α-naphtylamine and alkylated phenyl-x-naphtylamine; phenol-based ones, e.g., 2,6-di-t-butyl phenol, 4,4'-methylenebis-(2,6-di-t-butyl phenol) and isooctyl-3-(3,5-di-t-butyl-4-hydroxyphenyl)propionate; sulfur-based ones, e.g., dilauryl-3,3'-thiodipropionate; and zinc dithiophosphate. The antioxidant is incorporated normally at 0.05 to 5% by mass.

Examples of rust inhibitors useful for the present invention include a fatty acid, alkenylsuccinic acid half ester, fatty acid soap, alkylsulfonate, polyhydric alcohol/fatty acid ester, fatty acid amine, oxidized paraffin and alkylpolyoxyethylene ether. The rust inhibitor is incorporated normally at 0 to 37% by mass.

Examples of friction modifiers useful for the present invention include an organomolybdenum-based compound, higher alcohols such as oleyl alcohol and stearyl alcohol; fatty acids such as oleic acid and stearic acid; esters such as oleyl glycerin ester, steryl glycerin ester, and lauryl glycerin ester; amides such as lauryl amide, oleyl amide, and stearyl amide; amines such as laurylamine, oleylamine, stearylamine, and an alkyldiethanolamine; and ethers such as lauryl glycerin ether and oleyl glycerin ether, oil/fat, amine, sulfided ester, phosphoric acid ester, acid phosphoric acid ester, acid phosphorous acid ester and amine salt of phosphoric acid ester. The friction modifier is incorporated normally at 0.05 to 5% by mass.

A total content of additive(s) in the gear oil composition of the present invention is not limited. However, one or more additives (including the above-described solubilizing agent) may be incorporated at 1 to 30% by mass, preferably 2 to 15% by mass.

The lubricating fluids of the present disclosure can be characterized by a variety of standard tests known to one of skill in the art. Traction coefficients can be measured using PCS Mini-Traction Machine (MTM) from PCS Instruments, Ltd. measured at various slide/roll ratios, e.g., (0.1-200%), temperatures and loads ranging from 20N to 70N or a maximum Hertzian contact stress of 0.5 to 1.5 GPa. Kinematic viscosity may be determined by ASTM D445-06. Kinematic viscosity may also be calculated from a measurement of dynamic viscosity at low shear rates and density whereby Kinematic viscosity is the mathematical product of the two numbers. Viscosity index may be determined by ASTM D2270-04.

EXAMPLES

The following examples further describe and demonstrate illustrative embodiments within the scope of the present invention. The examples are given solely for illustration and are not to be construed as limitations of this invention as many variations are possible without departing from the spirit and scope thereof.

Example 1: Diester Preparation

A 3-liter three-neck round-bottom flask equipped with a mechanical stirrer, a heating mantle with a digital thermocouple controller and a Dean-Starke trap fitted with a cold water condenser was used as the synthesis reactor. To the vessel was added 615.6 grams of Emery® 658 (mixture of normal $C_8$ and $C_{10}$ carboxylic acids), 526.6 grams of Invista Terathane® 250 (poly-tetramethylene glycol of nominal average molecular weight of 250 Daltons), 100 grams of mixed xylenes and 10 grams of 50% hypo-phosphorous acid as catalyst. Nitrogen blanketed the reaction with a roughly 30 mL/min flow and used throughout the reaction and stripping. The temperature of the flask contents was raised to 145° C. and then ramped at 30° C./hr to a final reactor temperature of 230° C. Water evolution occurs at about 145° C. and is distilled by azeotrope with xylene into the Dean-Starke trap.

After reaching 230° C., the temperature was maintained for 8 more hours at which time 99+% of the theoretical water had been removed from the reaction mixture. The acid number of the reactor contents at this point was 5.88 mg KOH/gram.

The reaction mixture was cooled while pulling a vacuum (down to 10 Torr). When the reactor temperature reach 90° C., 90 grams of 10% sodium carbonate was added and the mixture stirred for 1 hour and held at 85° C. The aqueous phase was then removed and 90 mL of water was added to the flask and stirred for 1 hour at 85° C. The water phase was then allowed to separate and then removed.

With the reactor contents held at 85° C., 5 grams of Celatom® FW-14 was added and the reactor placed under high vacuum and held for 30 minutes. The vacuum was broken and the contents of the flask filtered to remove the solids. Weight of fluid obtained was 1035 grams (97.2% yield of theoretical yield of 1065.2 grams). The fluid obtained had an Acid # of 0.40 mg KOH/grams and a color of 2 Gardner.

Example 2: High Viscosity Ester Preparation

Experimental setup consisted of using a 3,000 ml three-neck round-bottom flask equipped with mechanical stirrer, heating mantle with digital thermocouple controller. The flask is also equipped with a nitrogen headspace flow of ~30 ml/Min., a Dean-Starke trap and cool water condenser to collect water/xylenes distillate. The mixture of normal $C_8$ and $C_{10}$ carboxylic acids, poly-THF and catalyst (Hypophosphorous Acid 50%) are charged to the flask and agitation is begun. Nitrogen flow is initiated and continued throughout the reaction phase and stripping phase. The temperature of the reaction is ramped quickly to 145° C., and then ramped moderately at an approximate rate of 5° C./10 minutes to the maximum reaction temperature 260° C.

Water evolution commences on or about 125° C. and is collected in the Dean-Starke trap, along with xylenes, which are returned to the reaction mass.

Reaction Charges and Steps: Phase I

The reactants are added in the following order: (1.) Charge 286 grams of EMPOL® 1008 Oleic Di-Acid to the reactor flask. (2.) Charge 296 grams of Invista Terathane® 250 to the reactor flask. (3.) Start agitation. (4.) Start Nitrogen flow through bubbler. (5.) Adjust heating set-point to 120° C. (6.) Charge 100 grams of xylenes to the reactor flask. (7.) Charge 3.0 grams of 50% hypo-phosphorous acid to the reactor flask. (8.) The water/xylenes azeotrope will start coming over at approximately 120-125° C. (9.) Increase the set-point on the reactor by 10° C. every 15 minutes. Drain and record the total amount of water that comes over in the bottom layer of the azeotrope every 15-20 minutes. (10.) Continue raising the heating set-point and recording the total amount of water removed until a maximum temperature set-point of 260° C. is reached. At some points prior to the temperature reaching 260° C. some of the xylenes will need to be removed from the Dean-Starke trap and collected and weighed to account for the total amount of xylenes in the system. (11.) Once the temperature in the reactor reaches 260° C., pull a 2 gm±0.1 gm sample and titrate for the Acid Number using the attached Acid Number test procedure. (12.) The reaction is over when the acid number of the material reached 0.50 mg KOH/gm or less. Sample the reactor for the acid number every two hours until the 0.50 mg KOH/gm is reached. Record all results on the run sheet. (13.) Once the acid number of 0.5 mg KOH/gm is reached, cool the reactor to 170° C. and proceed to Phase II of the reaction.

Reaction Charges and Steps: Phase II

The reactants are added in the following order: 1. Charge 129 grams of EMERY® 658 mixed n-$C_8$-$C_{10}$ acids. (2.) Water should start to evolve from within a couple of minutes of the addition. (3.) Raise the set-point on the reactor by 10° C. every 15 minutes. Drain and record the total amount of water that comes over in the bottom layer of the azeotrope every 15-20 minutes. (4.) Continue increasing the heating set-point and recording the total amount of water removed until a maximum temperature set-point of 260° C. is reached. At some point prior to the temperature reaching 260° C. some of the xylenes will need to be removed from the Dean-Starke trap and collected and weighed to account for the total amount of xylenes in the system. (5.) Once the temperature in the reactor reaches 260° C., pull a 2 gm±0.1 gm sample and titrate for the acid number. (6.) The reaction is over when the acid number of the material reached 1.0 mgK OH/gm or less. Sample the reactor for the acid number every two hours until the 1.0 mg KOH/gm is reached. (7.) Once the acid number of 1.0 mg KOH/gm is reached, cool the reactor to 170° C. and proceed to Phase III of the reaction.

Reaction Charges and Steps: Phase III

The reactants were added in the following order: (1.) Cool the reaction vessel to 90° C. (2.) Mix 1.0 gm of potassium carbonate in to 2.0 gram of water and stir until dissolved. (3.) Remove Nitrogen flow from the reactor. (4.) Add the potassium carbonate/water solution to the reactor. Maintain heat at 90° C. for one hour. (5.) Slowly add a vacuum on the reactor to remove dissolved carbon dioxide gas form the ester. As the foaming subsides, increase the vacuum to full vacuum. (6.) Increase the heat at 10° C. per 15 minutes to 150° C. and hold for 30 minutes to remove any last traces of water and xylenes from the ester. (7.) Break vacuum and filter hot, i.e. 100° C. through a pre-coated filter using ~1.0 gram Celatom® FW-14. (8.) Package ester into a container. (9.) Run a final Acid Number on the product which should be 0.5 mg KOH/gm or less.

Table 1 provides the data for a representative first diester of a polytetramethylene glycol made with a mixture of normal (linear) octanoic and decanoic carboxylic acids [Example 2]; and, a representative a second ester made with oleic dimer acid (a di-carboxylic acid) and a mixture of normal (linear) octanoic and decanoic carboxylic acids utilizing 1 mole of oleic dimer and 2 moles of polytetramethylene glycol [Example 2] of nominal average molecular weight 232 Daltons, with a range of 200-300 Daltons.

| | Wt %: | | | | | | | | | | |
|---|---|---|---|---|---|---|---|---|---|---|---|
| First Diester | 100 | 90 | 80 | 70 | 60 | 50 | 40 | 30 | 20 | 10 | 0 |
| Second Ester | 0 | 10 | 20 | 30 | 40 | 50 | 60 | 70 | 80 | 90 | 100 |
| KV @ 40 C., cSt | 18.7 | 25.3 | 33.8 | 44.7 | 59.1 | 77.2 | 98.0 | 130.1 | 175.9 | 230.2 | 310.1 |
| KV @ 100 C., cSt | 4.9 | 6.3 | 7.9 | 9.8 | 12.2 | 15.0 | 18.0 | 22.4 | 28.2 | 34.5 | 43.2 |
| Viscosity Index | 209 | 216 | 218 | 214 | 210 | 206 | 204 | 202 | 200 | 198 | 197 |

Figure 2:
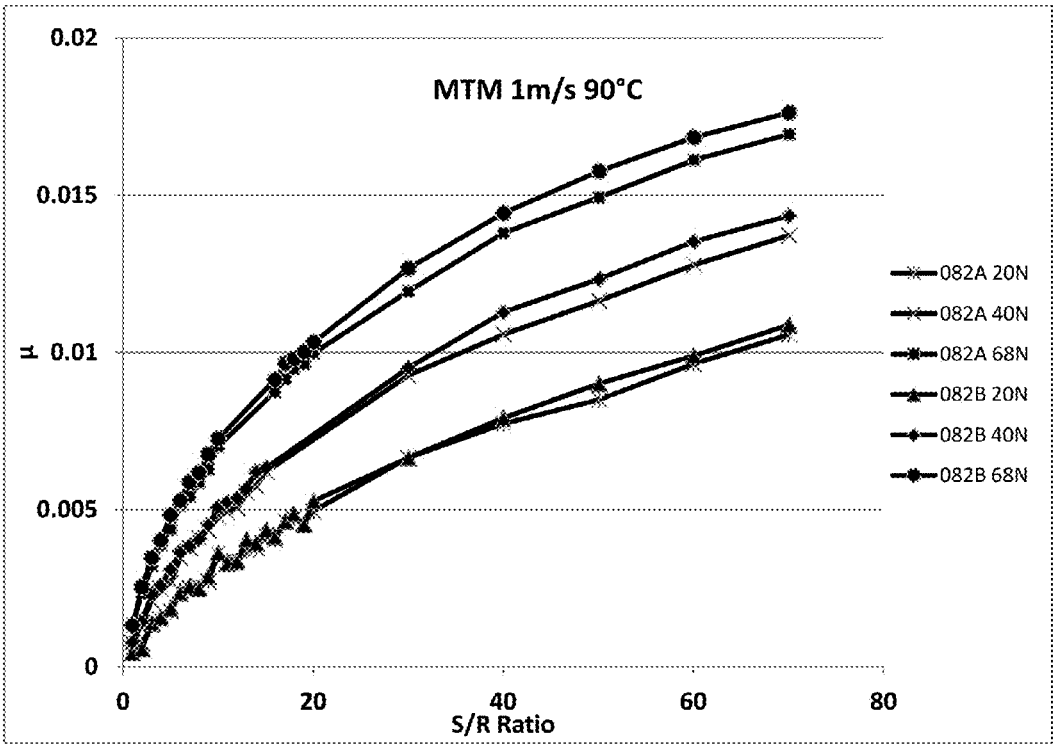
FIG. 2 illustrates the plots of slide/roll ratio versus traction coefficient, μ, measured at loads of 20N (0.8 GPa), 40N (1.0 GPa) and 68N (1.2 GPa), 90° C. and an entrainment speed to 1 meters/second for two different compositions of the present invention.
Figure 3:
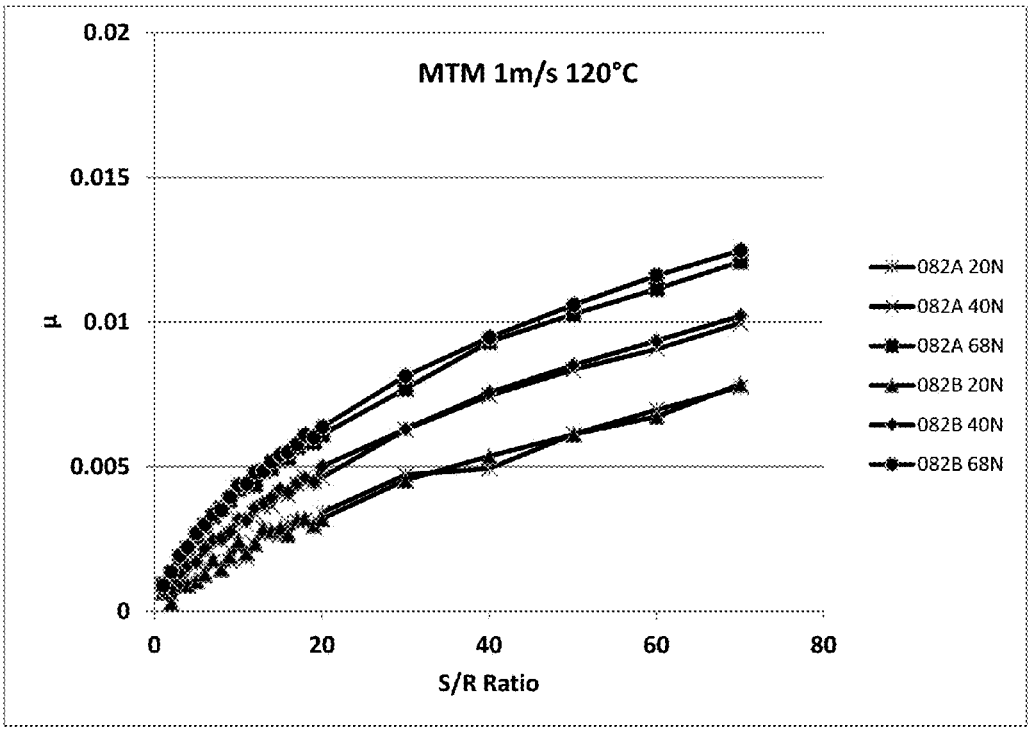
FIG. 3 illustrates the plots of slide/roll ratio versus traction coefficient, μ, measured at loads of 20N (0.8 GPa), 40N (1.0 GPa) and 68N (1.2 GPa), 120° C. and an entrainment speed to 1 meters/second for two different compositions of the present invention.
Figure 4:
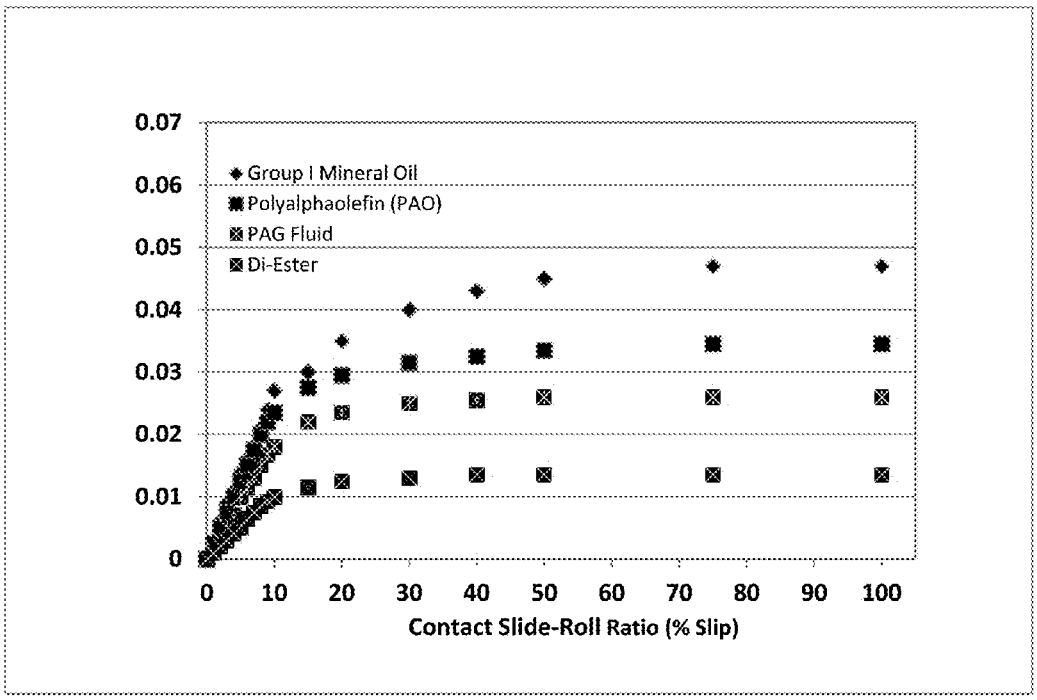
FIG. 4 illustrates a plot of slide/roll ratio versus traction coefficient, μ, measured at 1.2 GPa [68 N load] at 90° C. and 3 meters/sec entrainment velocity for a Group 1 mineral oil, a polyalphaolefin, a best-available, very-low shear strength poly-alkylene glycol and a composition of the present invention.

FIGS. 1-3 illustrate plots of the traction coefficients for an ISO 220 gear oil measured in a PCS Mini-Traction Machine with slide-roll ratio at an entrainment speed of 3 meters per second at various loads and temperatures on two fluids—a first diester and, a second ester, made by the procedures described in Example 1 and Example 2, respectively. The gear oil has a traction coefficient ranging from 0.012 to 0.025μ when measured at a slide to roll ratio of 40 percent, a load of 20N, 40N and 68N, 60° C. and an entrainment speed to 3 meters/second. The gear oil has a traction coefficient ranging from 0.008-0.015μ when measured at loads of 20N, 40N and 68N, 90° C. and an entrainment speed to 3 meters/second. The gear oil has a traction coefficient ranging from 0.007 to 0.010μ, measured at loads of 20N, 40N and 68N, 120° C. and an entrainment speed of 3 meters/second. Where loads of 20N, 40N and 68N correspond to maximum Hertzian contact stresses of 0.8, 1.0 and 1.2 GPa, respectively.

The present disclosure may be embodied in other specific forms without departing from the spirit or essential attributes of the invention. Accordingly, reference should be made to the appended claims, rather than the foregoing specification, as indicating the scope of the disclosure. Although the foregoing description is directed to the preferred embodiments of the disclosure, it is noted that other variations and modification will be apparent to those skilled in the art, and may be made without departing from the spirit or scope of the disclosure.

What is claimed:

1. A lubricating fluid comprising a combination of carboxyl di-ester of polytetramethylene glycols having the formulas of:

(1) a first carboxyl di-ester of polytetramethylene glycol having the structure of formula (1):

(1)

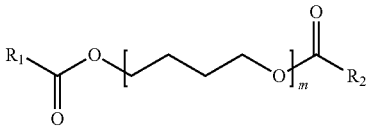

wherein $R_1$ and $R_2$ each independently comprise linear alkyl groups each having 5 to 11 carbon atoms and m ranges from 2 to 4;

(2) a second carboxyl di-ester of polytetramethylene glycol having the structure of formula (2):

(2)

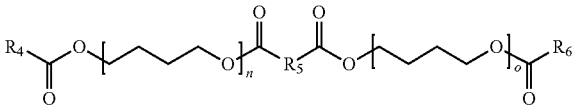

wherein $R_4$ and $R_5$ each independently comprise linear alkyl groups each having 5 to 11 carbon atoms; $R_3$ is a dicarboxylic acid, comprising linear alkyl groups having 24-36 carbon atoms and n ranges from 2 to 4 and o ranges from 2 to 4; and mixtures thereof.

2. The lubricating fluid of claim 1, wherein each polytetramethylene glycol segment of formula (1) and/or formula (2) has an average molecular weight ranging from 200 g/mole to 300 g/mole.

3. The lubricating fluid of claim 1 or 2, wherein the $R_1$ and $R_2$ are each independently derived from a mixture of octanoic carboxylic acid and decanoic carboxylic acid.

4. The lubricating fluid of claim 3, wherein the $R_4$ and $R_5$ are each independently derived from a mixture of octanoic carboxylic acid and decanoic carboxylic acid.

5. The lubricating fluid of claim 4, wherein $R_3$ is derived from a dimer carboxylic acid having 24-36 carbon atoms.

6. The lubricating fluid of claim 5, wherein the lubricant fluid has a traction coefficient ranging from 0.001-0.015μ when measured at a slide to roll ratio of 40 percent a load of 20N to 70N at 90° C.

7. The lubricating fluid of claim 6, wherein the lubricant fluid has a 40° C. Kinematic Viscosity ranging from 15 cSt to 1500 cSt.

8. The lubricating fluid of claim 7, further comprising at least one additive selected from the group consisting of: antioxidant, extreme pressure additive, anti-wear additive, friction modifier, rust inhibitor, corrosion inhibitor, detergent, dispersant, defoamer and combinations thereof.

9. The lubricating fluid of claim 8, wherein the first carboxyl di-ester of polytetramethylene glycol and the second carboxyl di-ester of polytetramethylene glycol are each liquids at 25° C.

10. A lubricating fluid comprising a carboxyl di-ester of polytetramethylene glycol having the structure of formula (2):

(2)

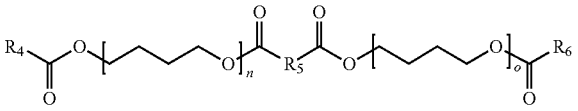

wherein $R_4$ and $R_5$ each independently comprise linear alkyl groups each having 5 to 11 carbon atoms; $R_3$ is a dicarboxylic acid, comprising linear alkyl groups having 24-36 carbon atoms and n ranges from 2 to 4 and o ranges from 2 to 4; and mixtures thereof.

11. The lubricating fluid of claim 10, wherein the $R_4$ and $R_5$ are each independently derived from a mixture of octanoic carboxylic acid and decanoic carboxylic acid.

12. The lubricating fluid of claim 11, wherein $R_3$ is derived from a dimer carboxylic acid having 24-36 carbon atoms.

13. The lubricating fluid of claim 12, wherein the lubricant fluid has a traction coefficient ranging from 0.001-0.015μ when measured at a slide to roll ratio of 40 percent a load of 20N to 70N at 90° C.

14. The lubricating fluid of claim 13, wherein the lubricant fluid has a 40° C. Kinematic Viscosity ranging from 15 cSt to 1500 cSt.

15. The lubricating fluid of claim 14, further comprising at least one additive selected from the group consisting of: antioxidant, extreme pressure additive, anti-wear additive, friction modifier, rust inhibitor, corrosion inhibitor, detergent, dispersant, defoamer and combinations thereof.

* * * * *